US005938110A

United States Patent [19]

Bernstein

[11] Patent Number: 5,938,110

[45] Date of Patent: Aug. 17, 1999

[54] MODULAR INTERLOCKABLE PACKAGING

[75] Inventor: Linda A. Bernstein, Maineville, Ohio

[73] Assignee: International Paper Company, N.Y.

[21] Appl. No.: 08/892,217

[22] Filed: Jul. 14, 1997

[51] Int. Cl.[6] ..... B65D 5/32

[52] U.S. Cl. ..... 229/125.28; 229/117; 229/117.06; 229/125.29; 229/164; 229/404; 229/405

[58] Field of Search ..... 229/101, 117, 229/117.06, 125.19, 125.12, 125.125, 125.28, 125.29, 125.32, 164, 400, 404, 405, 906, FOR 100, FOR 103

[56] References Cited

U.S. PATENT DOCUMENTS

| | | | |
|---|---|---|---|
| 283,209 | 8/1883 | Colburn | 229/125.32 |
| 1,319,973 | 10/1919 | Simpson . | |
| 1,357,519 | 11/1920 | Russell | 229/125.32 |
| 2,022,305 | 11/1935 | Wellman | 229/164 |
| 2,426,911 | 9/1947 | Williamson . | |
| 2,435,355 | 2/1948 | Ingram . | |
| 2,722,363 | 11/1955 | Schaller | 229/101 |
| 2,936,941 | 5/1960 | Lewis | 229/125.28 |
| 3,031,070 | 4/1962 | Mulder | 229/101 |
| 3,276,662 | 10/1966 | Farquhar | 229/125.32 |
| 4,017,015 | 4/1977 | Jefferson . | |
| 4,502,623 | 3/1985 | Moore, Jr. et al. | 229/400 |
| 4,784,315 | 11/1988 | Dutcher . | |
| 4,804,137 | 2/1989 | Harby | 229/125.28 |
| 5,016,753 | 5/1991 | Henderson | 229/125.32 |

*Primary Examiner*—Gary E. Elkins
*Attorney, Agent, or Firm*—Ralph J. Skinkiss

[57] ABSTRACT

The present invention relates to a modular food package particularly suitable for use in the fast food industry, and more particularly to a modular package that can be used as a stand alone, open ended, scoop type, package suitable for containing food items, such as french fries, potato cakes, cookies, pies, and such, or two identical units may be combined to create a completely enclosed, and interlocking, package for a sandwich or other appropriate food items.

14 Claims, 16 Drawing Sheets

MODULAR INTERLOCKABLE PACKAGING

BACKGROUND OF THE INVENTION

The present invention relates to a modular food package particularly suitable for use in the fast food industry, and more particularly to a modular package that can be used as a stand alone, open ended, scoop type, package suitable for containing food items, such as french fries, potato cakes, cookies, pies, and such, or two, identical, units may be combined to create a completely enclosed, and interlocking package for a sandwich or other appropriate food items.

At present the prior art, in the fast food industry, provides open ended, or scoop type, packages particularly for fast food items such as french fries and potato cakes. Such packaged food items, when placed within a bag for carryout service, typically fall over spilling the contents of the open ended package. Further, within the fast food industry, larger food items, such as specialty sandwiches, are typically wrapped with a paper covering, placed within an open ended package, and delivered to the purchaser.

SUMMARY OF THE PRESENT INVENTION

By the present invention, a modular, open ended, or scoop type, fast food package is disclosed and taught that may be used as a stand alone, open ended package and/or two such, identical, open ended packages may be opposingly combined to form a totally enclosed package. Fast food packages, in accord with the teachings of the present invention, may be specifically configured to serve a multiplicity of food items such as french fries, potato cakes, and cookies, or may be configured for serving sandwich items. In either situation, two identical, open ended packages may be combined to form a fully enclosed food containing, modular package. Thus, fast food packages no longer need to be carefully placed within carryout bags to prevent inadvertent spillage. Further, by use of the herein disclosed fast food package a single, open ended, package may be used for in-store service of a food item, such as a sandwich, while the combined modular package may be used for take-out service. Thus an open end package may be used for in-store service and an enclosed package used for take-out service without additional cost or inventory.

The improved interlocking, open ended package as disclosed and taught herein comprises a collapsed scoop type package (convenient for bulk shipping the package to the end user) having either a pop-up or automatic type bottom so that when opened for use it forms a scoop type fast food package having a back wall portion extending upward from the main package portion. Extending from the back wall to the front wall of the package, at each side thereof, is a sloped portion of each side wall which will telescopingly slide inside an opposing package thereby forming a fully enclosed package. The sloped portion of each side wall meets the front wall forming a "V" type notch therebetween. As two packages are telescopingly brought together the front wall of one package slides upward along the sloped side walls of the other. When two of the packages are telescopingly brought together the notches of one package interlock with the notches of the opposing package thereby interlocking one with the other thereby forming a fully enclosed package. By providing a notch at the juncture of each side wall and front wall, a front wall tongue is thereby formed at the free edge of the front wall extending between the notches. When two packages are brought together, as described above, the front wall tongue of one package overrides the tongue of the other package providing a closure therebetween.

By use of the herein disclosed modular package a single, open ended, package might be used for in-store service of a food item such as a sandwich while the combined modular package might be used for take-out service.

DETAILED DESCRIPTION OF THE PREFERRED EMBODIMENT

Figure 1:
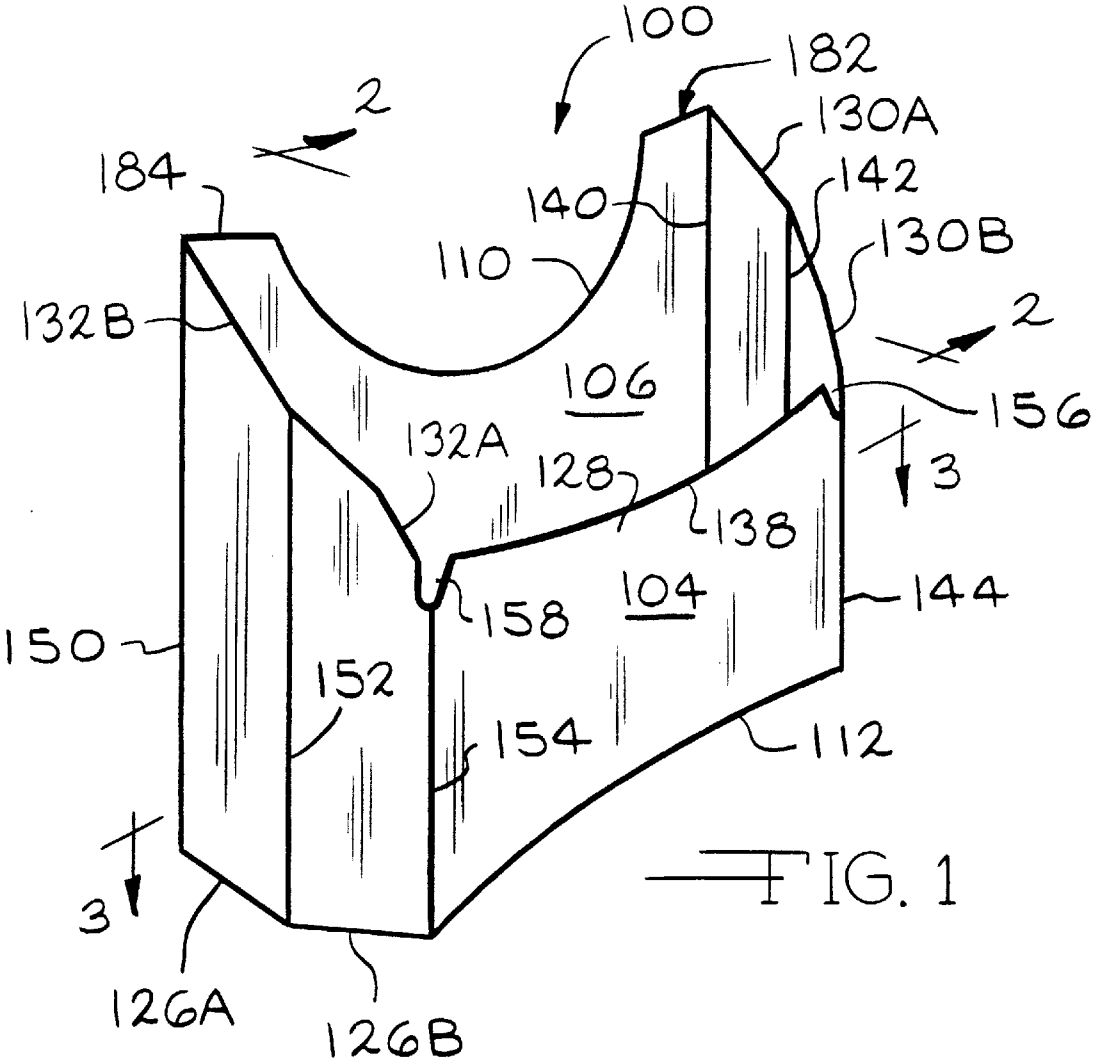
FIG. 1 presents a pictorial view of a first embodiment of a modular, open ended, pop-up, scoop type, fast food package embodying the present invention in its expanded configuration and ready for use.
Figure 2:
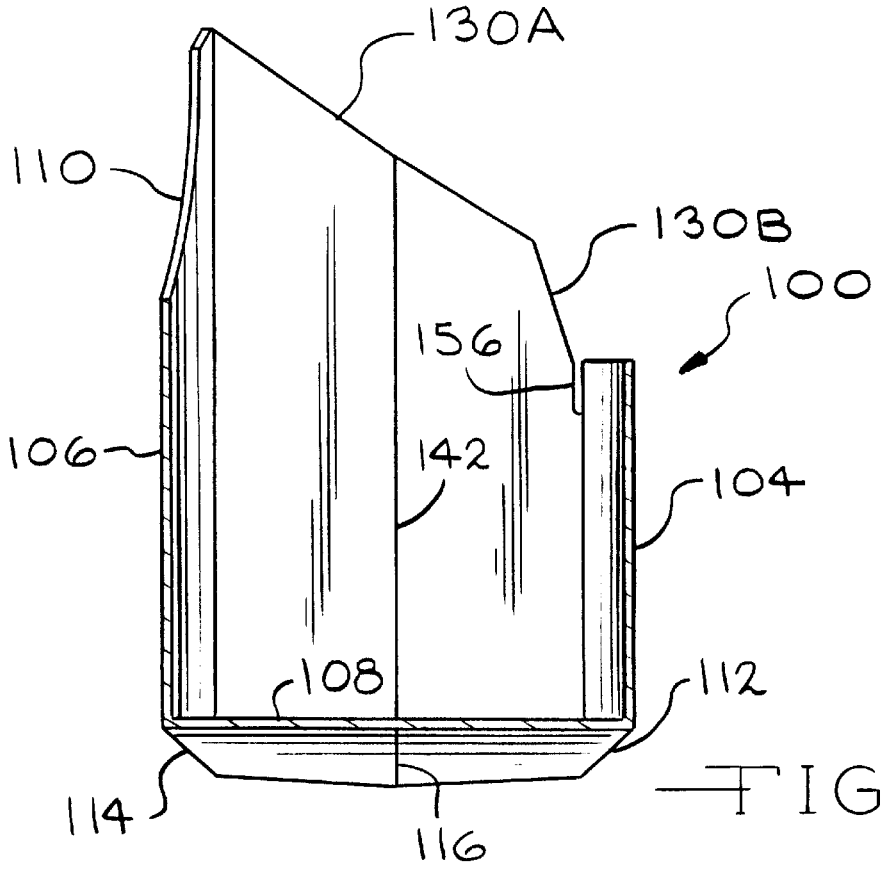
FIG. 2 presents a cross sectional view taken along line 2—2 in FIG. 1.
Figure 3:
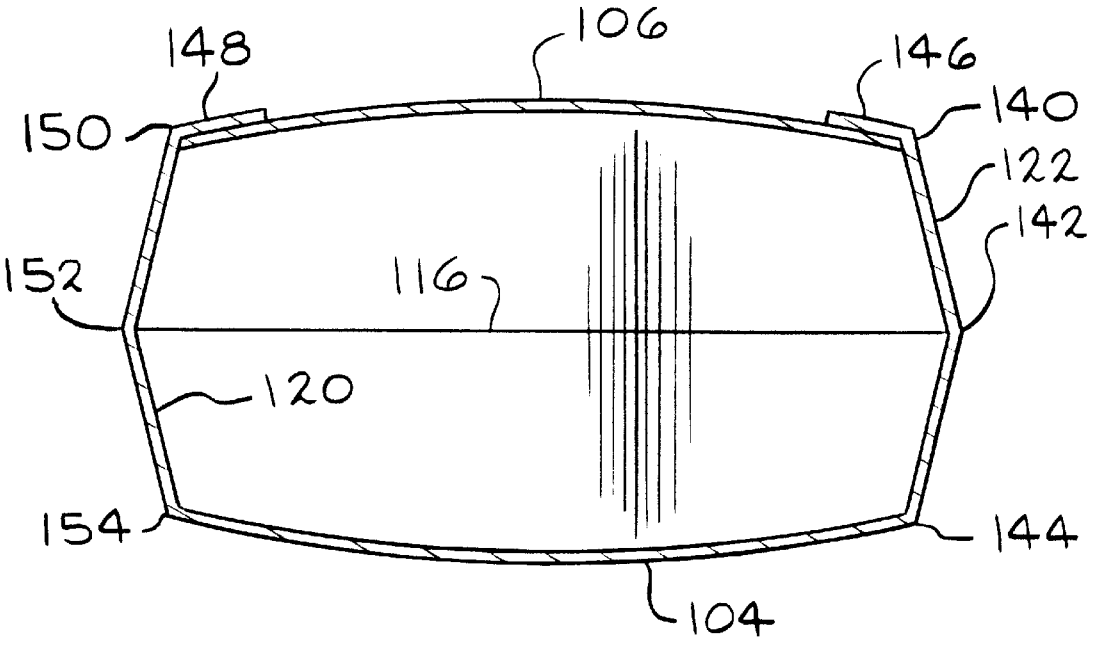
FIG. 3 presents a cross sectional view taken along line 3—3 in FIG. 1.

FIGS. 1 through 3 generally illustrate a first embodiment of an open ended, modular fast food package 100, made in accord with the present invention, particularly suitable for serving fast food of the sandwich type.

Figure 4:
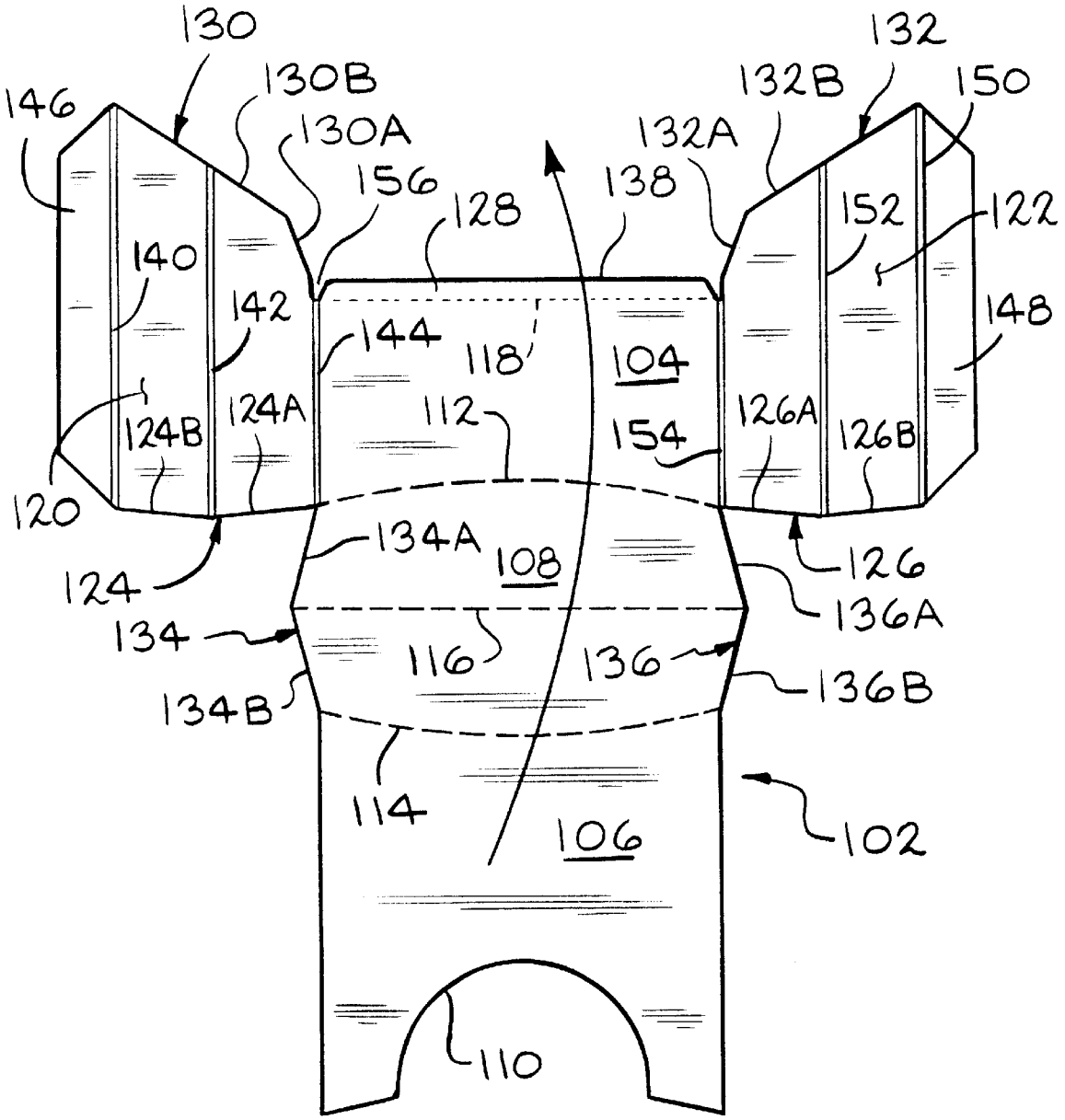
FIG. 4 presents a plan view of a unitary paperboard blank from which the package as illustrated in FIG. 1 is formed.

Referring additionally to FIG. 4, the unitary blank 102 is typically cut from a sheet of suitable paperboard, or other stiff bendable and resilient sheet material in the configuration as shown. Blank 102 includes a generally rectangular front and rear wall, 104 and 106 respectively, separated by a pop-up bottom panel 108. The back wall may be provided a cut out 110 as shown which will be discussed in further detail below. Opposing arcuate, perforated fold lines 112 and 114 separate bottom panel 108 from front wall 104 and back wall 106 respectively. Bisecting bottom panel 108 is perforated fold line 116. Extending from either side of front wall 104 are right and left side walls (as viewed in FIG. 1) 120 and 122. The bottom edges 124 and 126, of end wall 120 comprise segments 124A and 124B. The length of segments 124A, and 124B correspond to, and are slightly longer than, segments 134A and 134B, of bottom panel 108. Similarly, segments 126A and 126B, of bottom edge 126 of left side wall 122, are slightly longer than corresponding segments 136A and 136B of bottom panel 108.

Top edge 130 and 132 of right and left walls 120 and 122, respectively, comprise straight line segments 130A, 130B, 132A, and 132B as best shown in FIG. 4. Although segments 130A, 130B, 132A, and 132B are disclosed as being straight line segments, these segments may also be curved if desired. End walls 120 and 122 also include scored fold lines 140, 142, 144, 150, 152, and 154 as best seen in FIG. 4. Fold line 142 is positioned approximately midway between fold line 140 and 144 and fold line 152 is positioned approximately midway between fold lines 150 and 154. For assembly each end wall 120 and 122 is provided a glue tab 146 and 148 respectively.

Front wall 104 terminates, at top edge 138 which meets the right and left end wall edge segments 130A and 132A forming notches 156 and 158 there between as best illustrated in FIG. 4. Front wall top edge 138 forms a tongue 128 with respect to imaginary line 118 extending between the bottom of notches 156 and 158.

Figure 5:
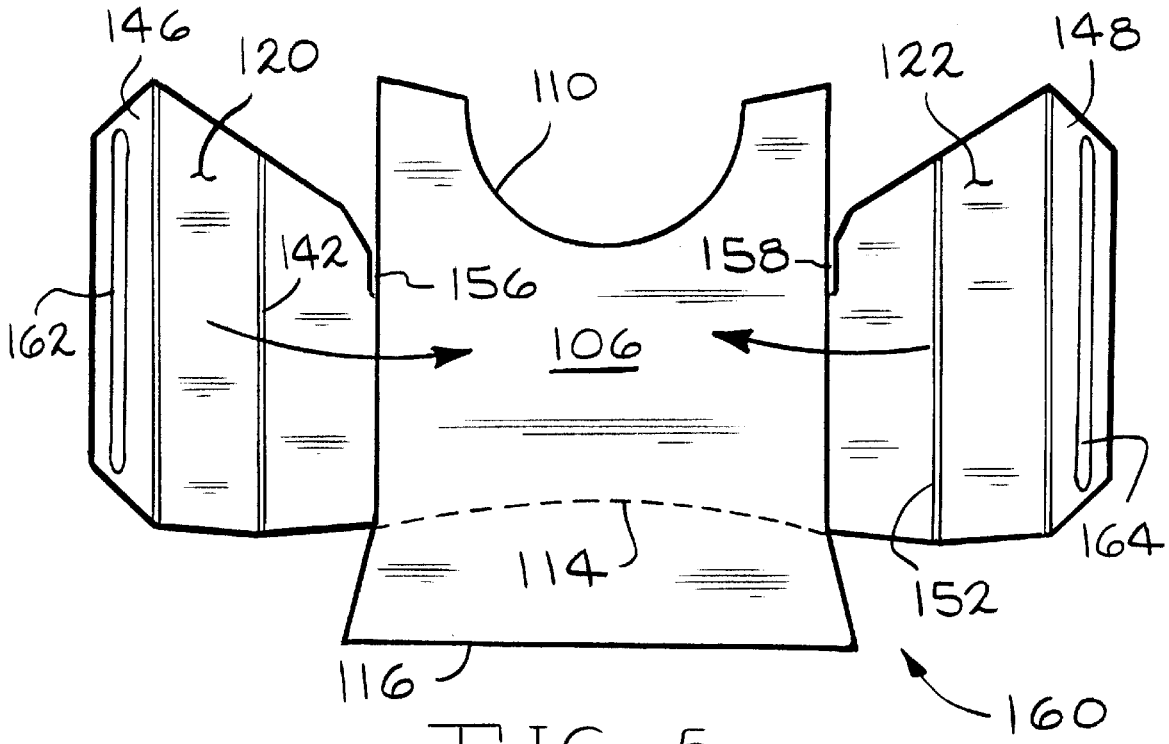
FIG. 5 presents a planar view of the paperboard blank, shown in FIG. 4, after its first folding operation, during manufacture, thereby producing a first perform.
Figure 6A:
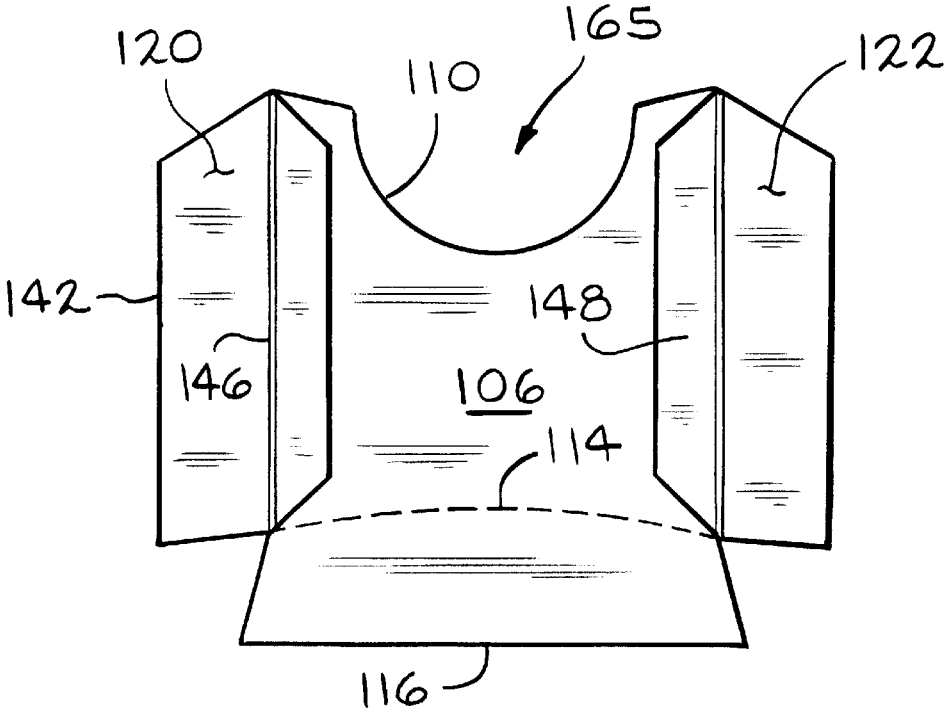
FIG. 6A presents a planar view of the paperboard blank, shown in FIG. 4, after its second folding operation thereby producing a second perform.
Figure 6B:
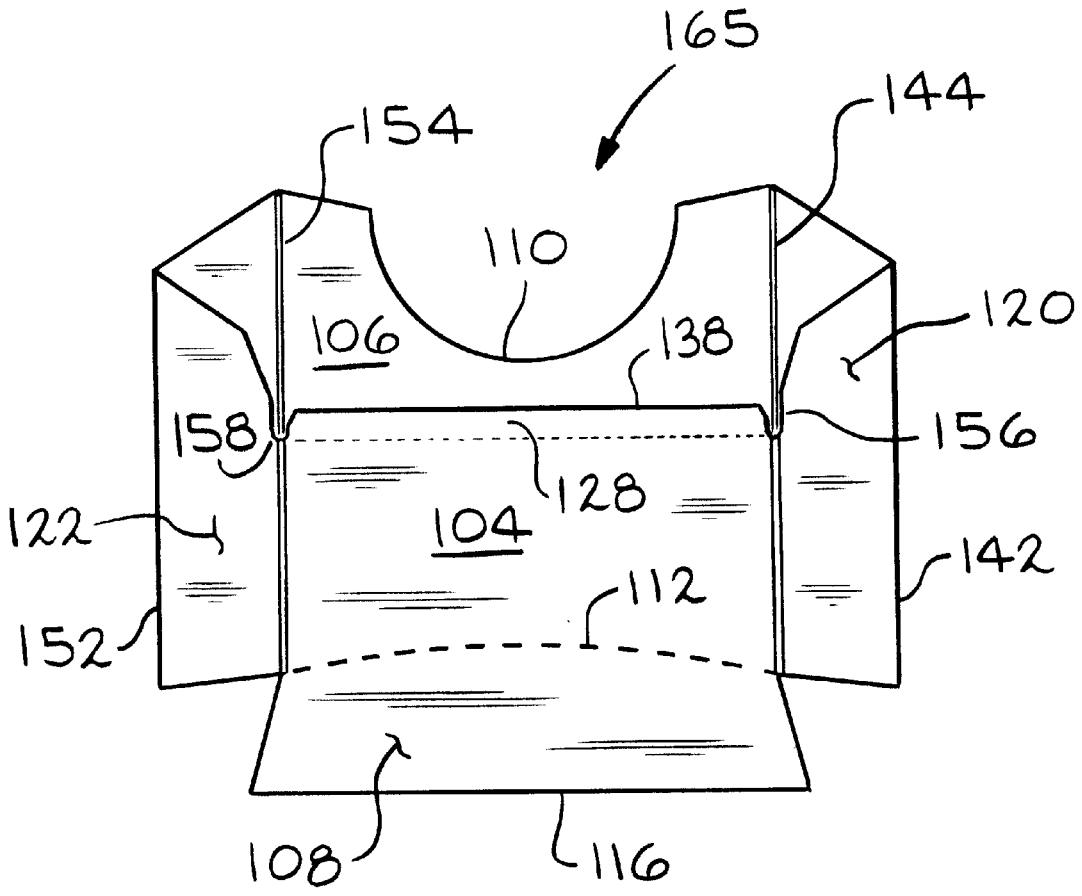
FIG. 6B presents a planar view of the paperboard blank, shown in FIG. 4, flipped over 180 degrees thereby showing the front side of the second perform.

Assembly of the subject package is accomplished first by folding the back wall 106, of blank 102, upward, as viewed in FIG. 4, about fold line 116 of bottom panel 108, so as to lie over top of front wall 104 forming a first perform 160 as illustrated in FIG. 5. The outer portion of right and left end walls 120 and 122, extending outward from fold lines 142 and 152 respectively, are then folded, about fold lines 142 and 152 upward, from the plane of FIG. 5 as indicated by the arrows, so as to overlie the inward portion of each respective end wall and a portion of back wall 106 thereby forming a second perform 165 as illustrated in FIG. 6A. When end walls 120 and 122 are folded over top of back wall 106 and adhesively secured to back wall 106 by adhesive strips 162 and 164 on tabs 146 and 148. FIG. 6B illustrates the front side of the perform 165 as illustrated in FIG. 6A. Perform 165 is the final perform and represents the flat configuration by which the subject package is shipped.

To open perform 165 for use, the end user expandingly separates the front and back walls, 104 and 106, whereby causing end walls 120 and 122 to fill the gap created there between and snap the bottom wall 108 upward between the front and back wall about fold lines 114 and 112 thereby creating the open package 100 as illustrated in FIGS. 1 through 3.

Figure 7:
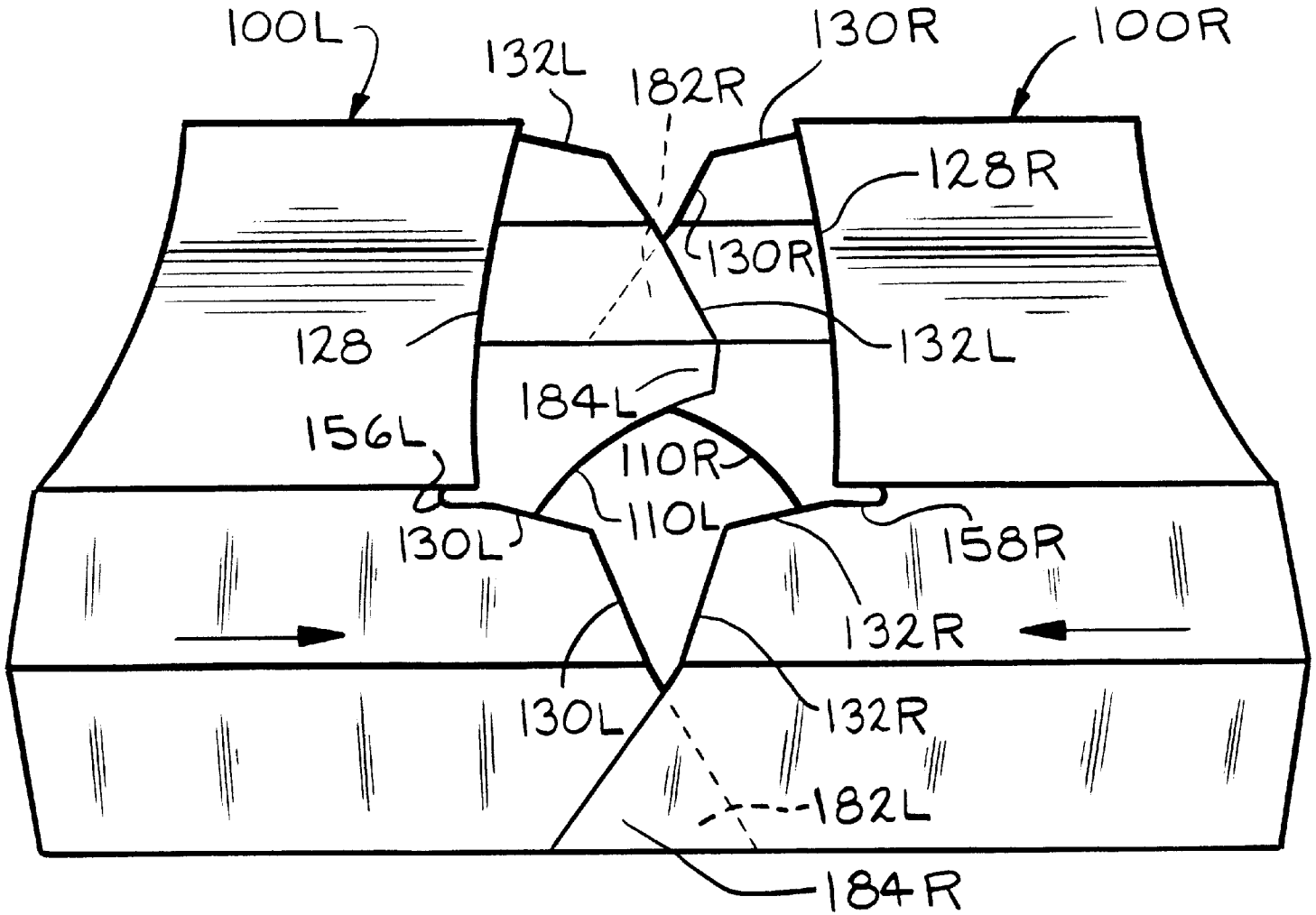
FIG. 7 presents a pictorial view of two of the open ended packages, as illustrated in FIG. 1, being telescoped, one into the other, to form a unique enclosed fast food package.
Figure 8:
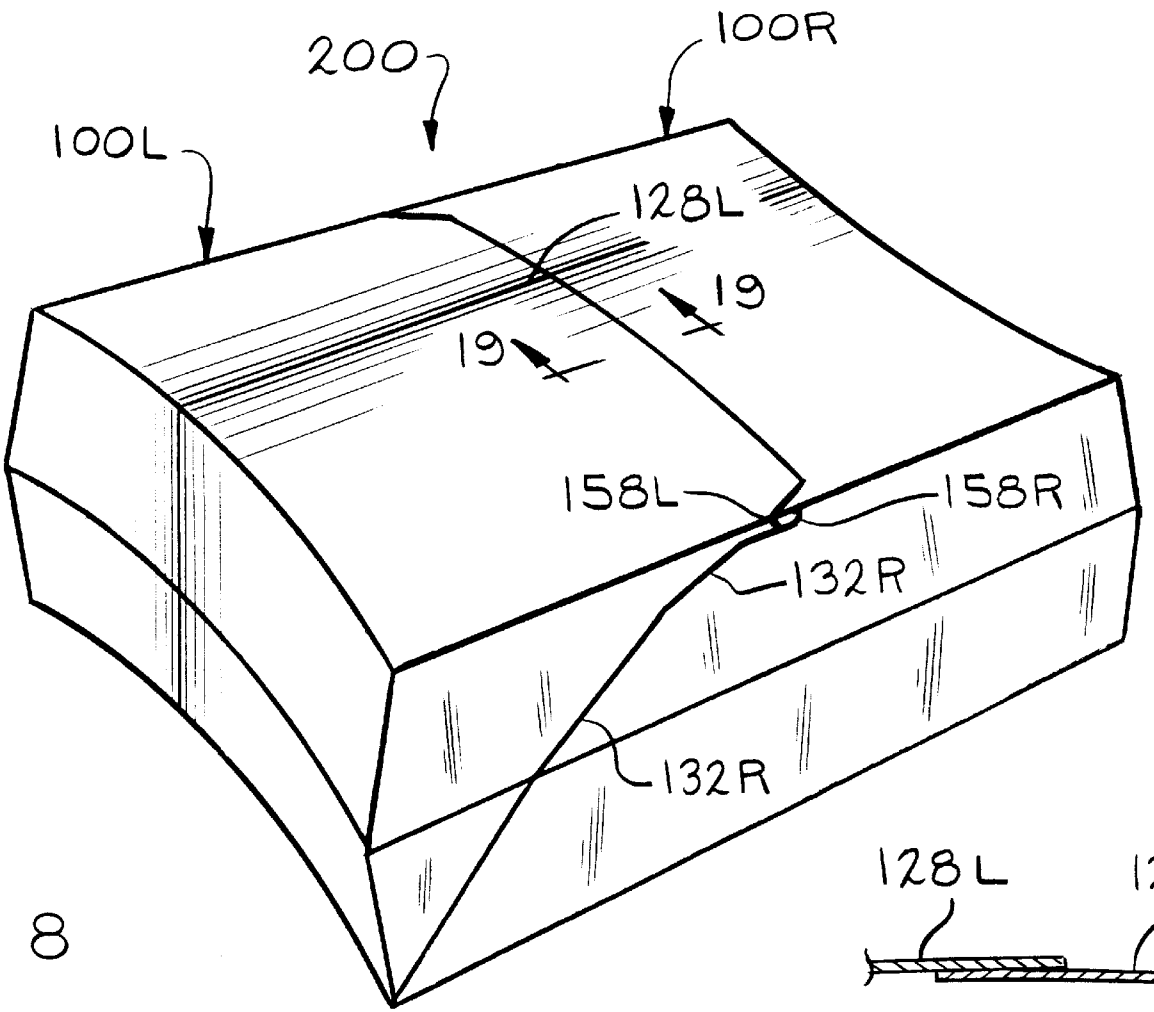
FIG. 8 presents a pictorial view of the final enclosed fast food package formed by telescoping two of the packages, as illustrated in FIG. 7.
Figure 19:
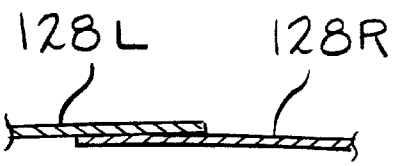
FIG. 19 presents a cross sectional view taken along line 19—19 in FIG. 8.

Referring now to FIGS. 7, 8, and 19, two identical, open ended, fast food packages, as illustrated in FIG. 1, 100L and 100R are illustrated as being assembled (package 100L telescoping into package 100R) to form a composite, enclosed, fast food package 200 as illustrated in FIG. 8.

To form enclosed package 200 the left and right projections 182 and 184 (see FIG. 1) of package 100L (now identified by element numbers 182L and 184L) are telescopingly inserted inside left and right projections 182R and 184R of package 100R as illustrated in FIG. 7. When packages 100L and 100R are combined to form enclosed package 200, as illustrated in FIG. 8, tongue 128L, of package 100L, over laps tongue 128R, of package 100R, as illustrated in FIG. 19 forming a closure therebetween. Cutout 100R, see FIG. 7, permits the fast food purchaser to grip the front and rear wall of package 110L for easy separation of the modular package halves 100L and 100R for removal of the food item therein. Further, if cutout 110 is given a large radius of curvature, as shown in FIGS. 1 through 6, a food item, such as a sandwich, may be consumed while being held within the package half.

A fast food package in accord with the present invention may be provided with any number of configurations and/sizes. The size and configuration will typically be determined by the particular food product delivered therein. For example a package configured to accommodate a sandwich type product may have a rear wall height approximately equal to the width of the package thereby accommodating a typical round sandwich product, or the rear wall height may extend upward approximately twice the height of the package width to accommodate an elongate food product such as french fried potatoes. Such an elongated package is illustrated below.

Figure 9:
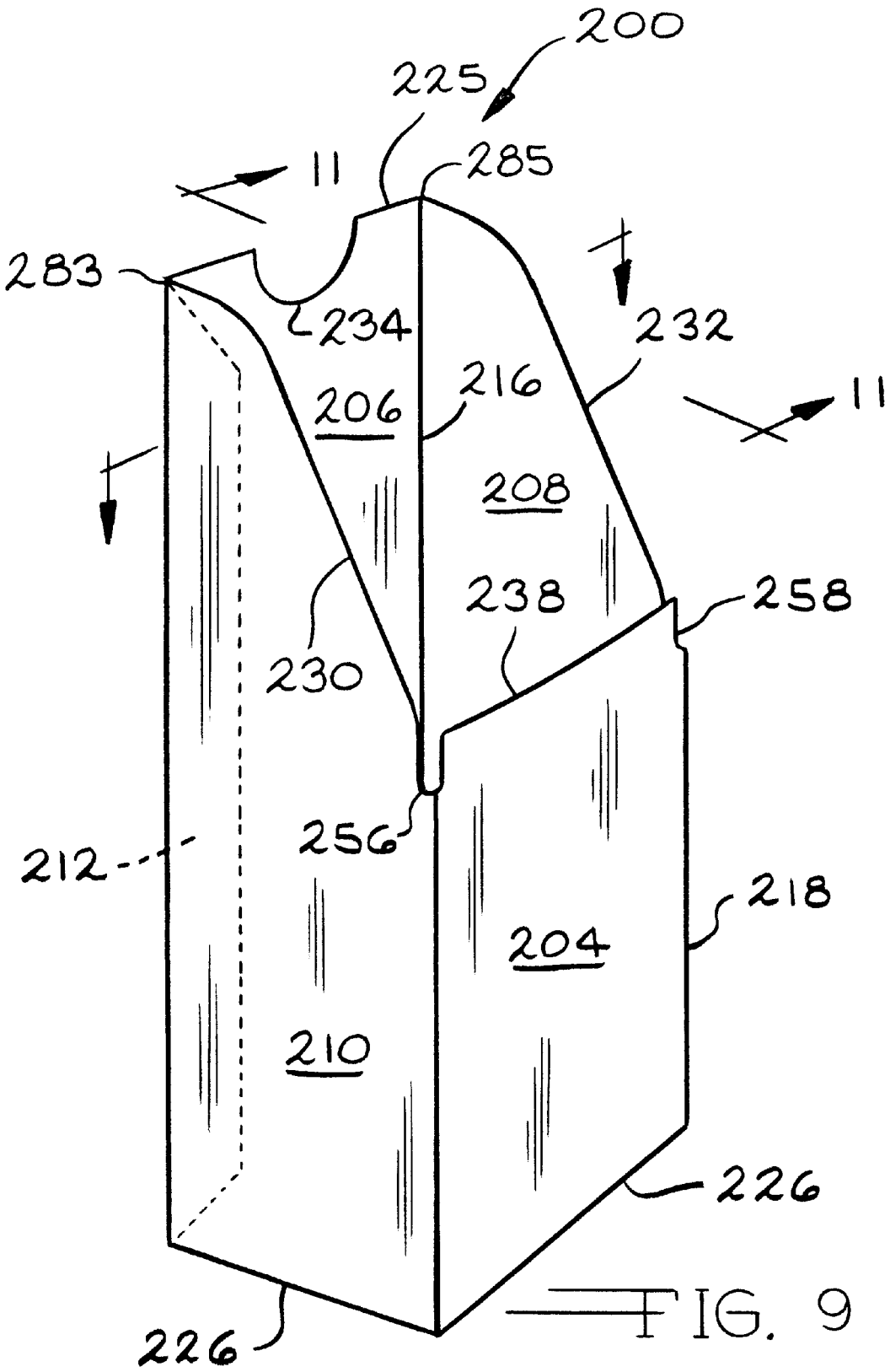
FIG. 9 presents a pictorial view of a second embodiment of the present invention illustrating an, elongated, modular, open ended, auto-bottom, fast food package in its expanded configuration and ready for use.
Figure 11:
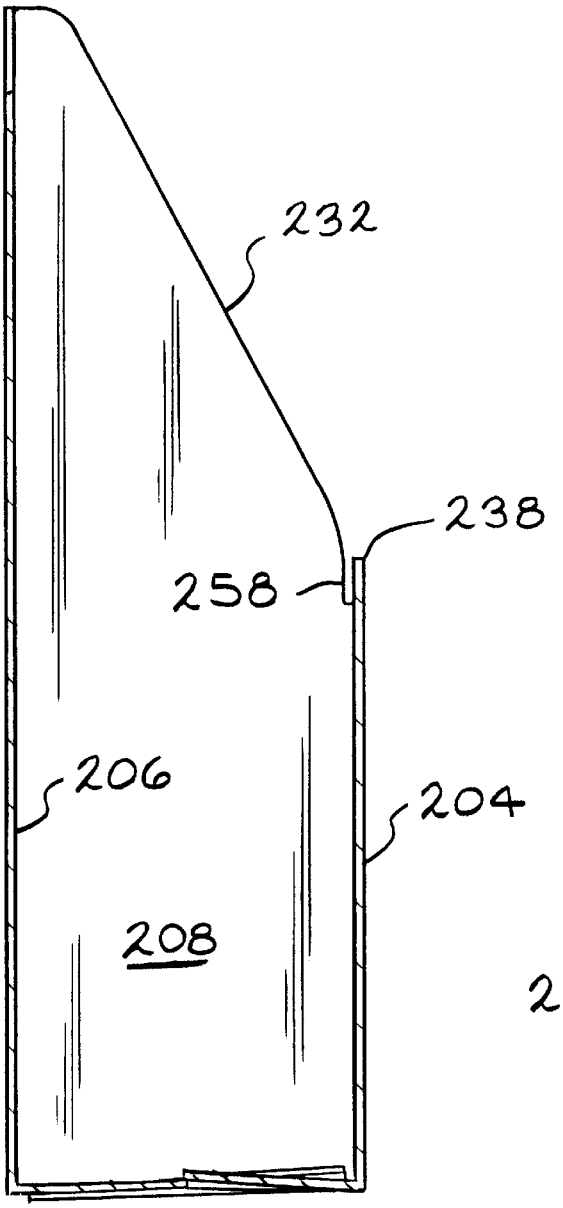
FIG. 11 presents a cross sectional view taken along line 11—11 in FIG. 9.
Figure 10:
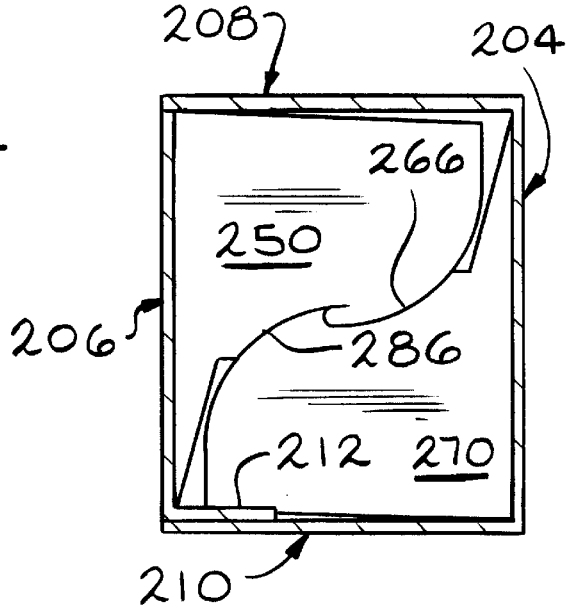
FIG. 10 presents a cross sectional view taken along line 10—10 in FIG. 9.

Referring now to FIGS. 9 through 11, a second embodiment of the present invention is illustrated. Fast food package 200 is particularly suited for serving elongated fast foods such as french fries. Similar to the discussion for the sandwich type package 100 above, reference to left and right sides of package 200 will be as the package 200 is viewed in FIG. 9 with the left side wall indicated as element number 210 and the front wall identified by element number 204.

Figure 12:
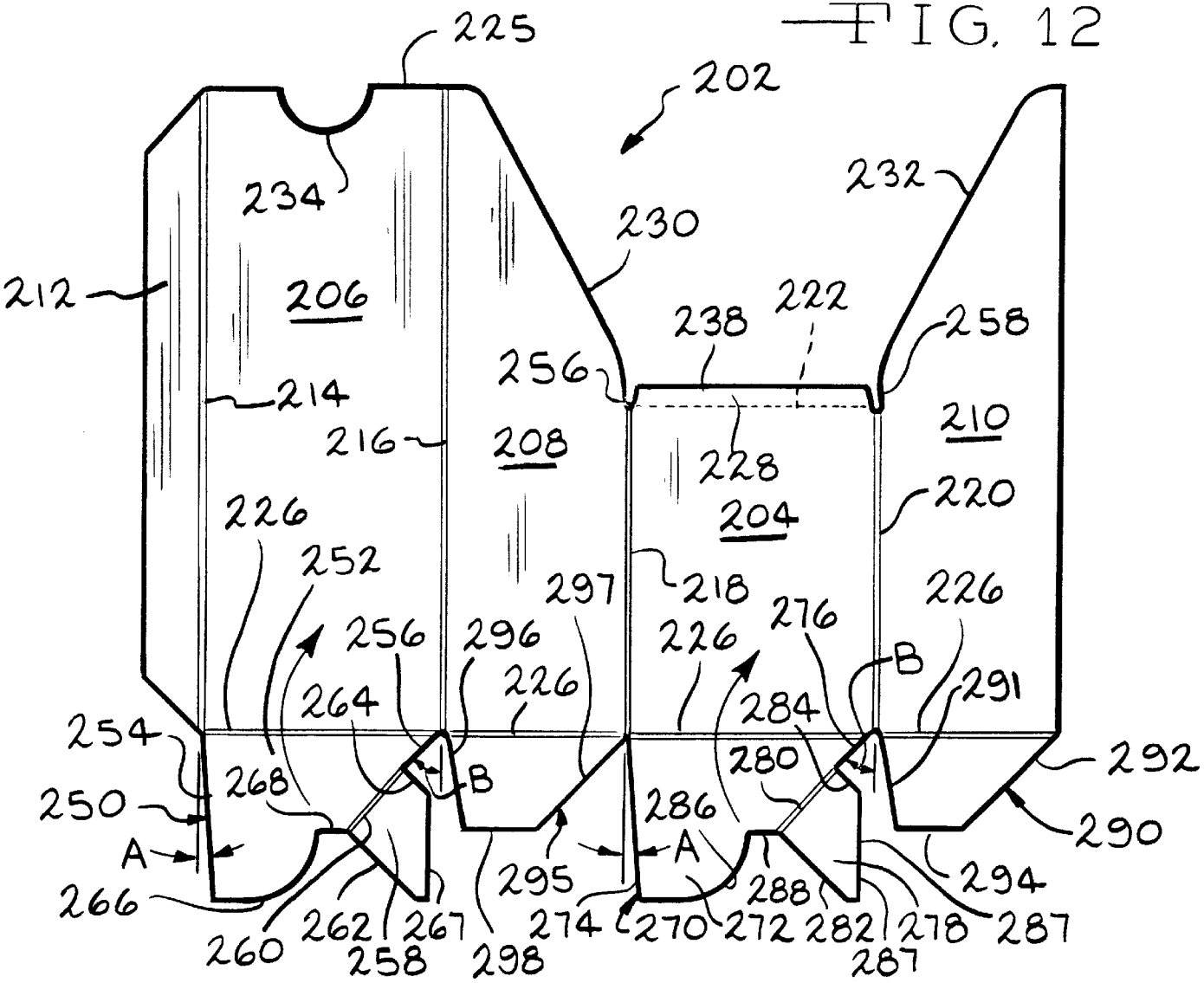
FIG. 12 presents a plan view of a unitary paperboard blank from which the package as illustrated in FIG. 9 is formed.

Referring additionally to FIG. 12, a unitary blank 202 is typically cut from a sheet of suitable paperboard, or other stiff bendable and resilient sheet material in the configuration as shown. Blank 202 includes a generally rectangular front and rear wall, 204 and 206 respectively. Between front wall 204 and back wall 206 is right side wall 208. Left side wall 210 extends from the opposite side of front wall 204 as illustrated. Glue tab 212 extends from back wall 206.

Scored fold line 214 separates back wall 206 from glue tab 212. Scored fold lines 216 and 218 flank right side wall 208 thereby defining and separating right side wall 208 from back wall 206 and front wall 204 as illustrated in FIG. 12. Similarly scored fold line 220 separates front wall 204 from left side wall 210.

Top edge 230 and 232 of right and left walls 208 and 210 generally comprise straight line segments as best shown in FIG. 12. Although segments 230, and 232 are disclosed as being straight line segments, these segments may also be curved if desired. Straight line segments 230 and 232 curvingly terminate at notch 256 and 258 at one end and at the back wall top edge 225. It is to be appreciated that line segment 232 terminates at the back wall top edge 225 in the package's assembled state as will become more clear below. Front wall 204, side walls 208 and 210, and back wall 206 share a common bottom boundary at scored fold line 226 extending across the full width of blank 202 as illustrated in FIG. 12.

Front wall 204 terminates, at top edge 238 which meets the left and right end wall top edge segments 230 and 232 forming notches 256 and 258 therebetween as best illustrated in FIGS. 12 and 9. Front wall top edge 238 forms a tongue 228 with respect to imaginary line 222 extending between the bottom of notches 256 and 258.

Extending downward from common fold line 226 are bottom panels 250, 270, 290, and 295. Bottom panels 250, 270, 290, and 295 generally comprise the typical elements of an automatic folding bottom known within the industry as an automatic bottom.

Bottom panel 250 generally comprises a main portion 252 having a straight line edge 254 offset at a slight angle A from the extended fold line 214 as illustrated in FIG. 12. An opposing edge 260 is angularly offset from extended fold line 216 by angle B as illustrated in FIG. 12. Folding tab 258 extends outward from the main portion 252 at a right angle to edge 255 and is separated from portion 252 by scored fold line 260 representing the extended straight edge 255. The side edges 262 and 264, of tab 258, extend outward from edge 255 at right angles thereto and terminate at vertically extending edge 267. Extending from edge 254 to side edge 262, of tab 250, is a curved caming edge 266 and straight edge 268.

Bottom panel 270 is identical in configuration to bottom panel 250. Therefore, element numbers 252, 254, 255, 258, 260, 262, 264 266, 267 and 268 are also identical to, and correspond to, element numbers 272, 274, 276, 278, 280, 282, 284, 286, 287 and 288 respectively.

Bottom panel 290 generally comprises a trapezoidal configuration attached to side panel 210 at fold line 226. Converging, and opposing, side edges 291 and 292 terminate at horizontal edge 294. Similar to bottom panels 250 and 270, bottom panels 290 and 295 are identical with element numbers 291, 292, and 294 corresponding to element numbers 296, 295, and 298 respectively.

Figure 13:
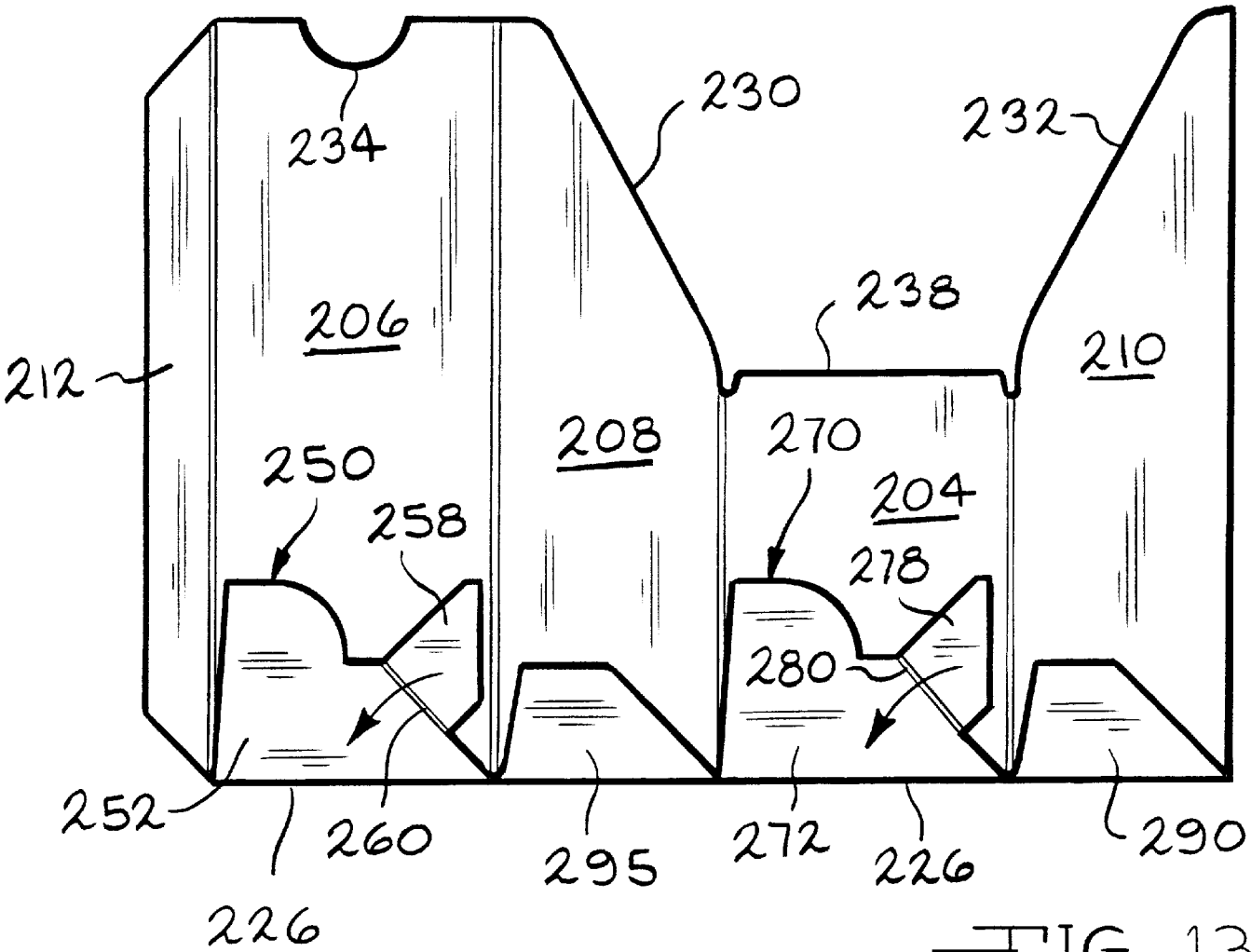
FIG. 13 presents a planar view of the paperboard blank, as shown in FIG. 12, after its first folding operation during manufacture.
Figure 14:
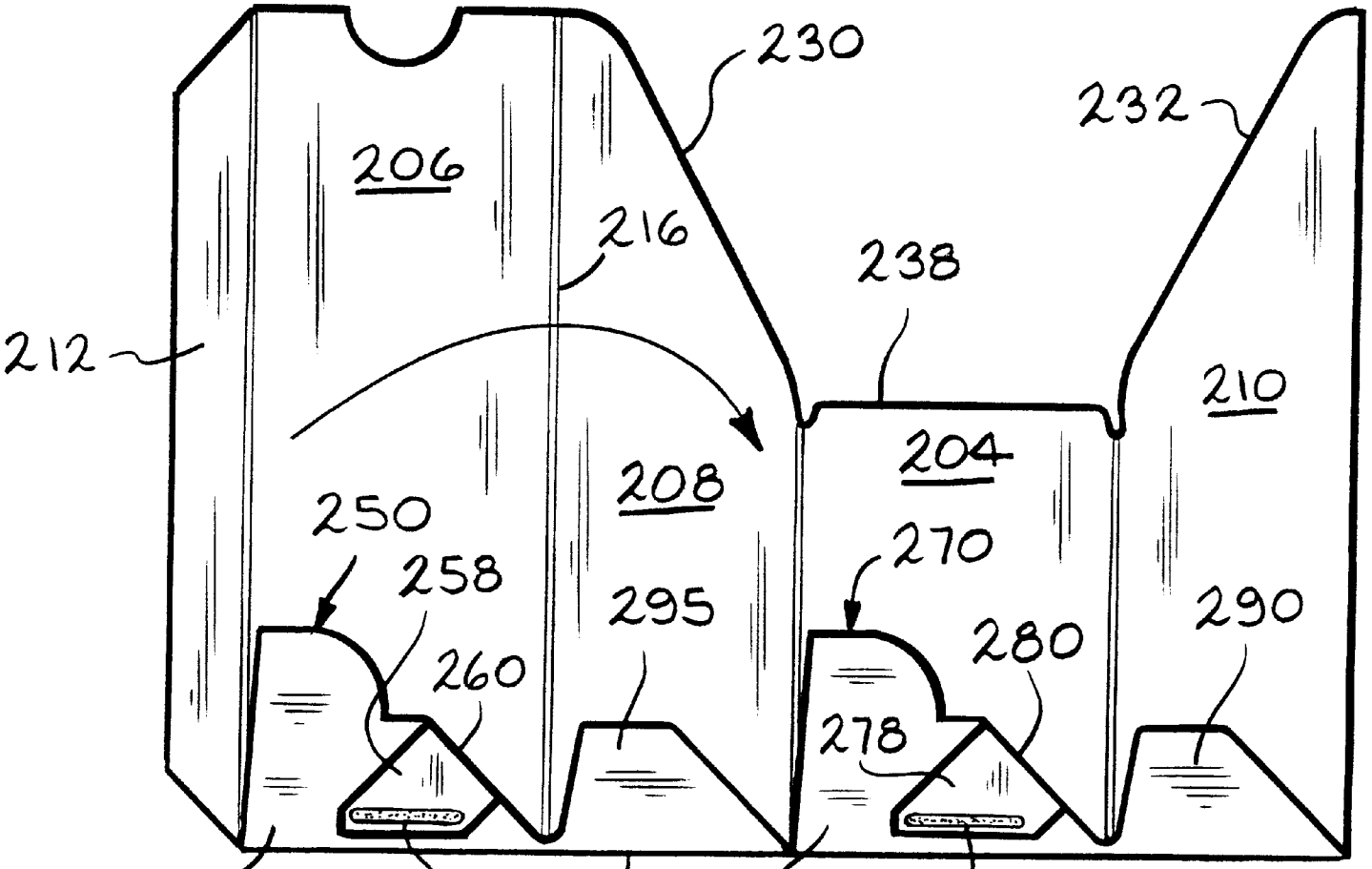
FIG. 14 presents a planar view of the paperboard blank, as shown in FIG. 12, after its second folding operation during manufacture.
Figure 16A:
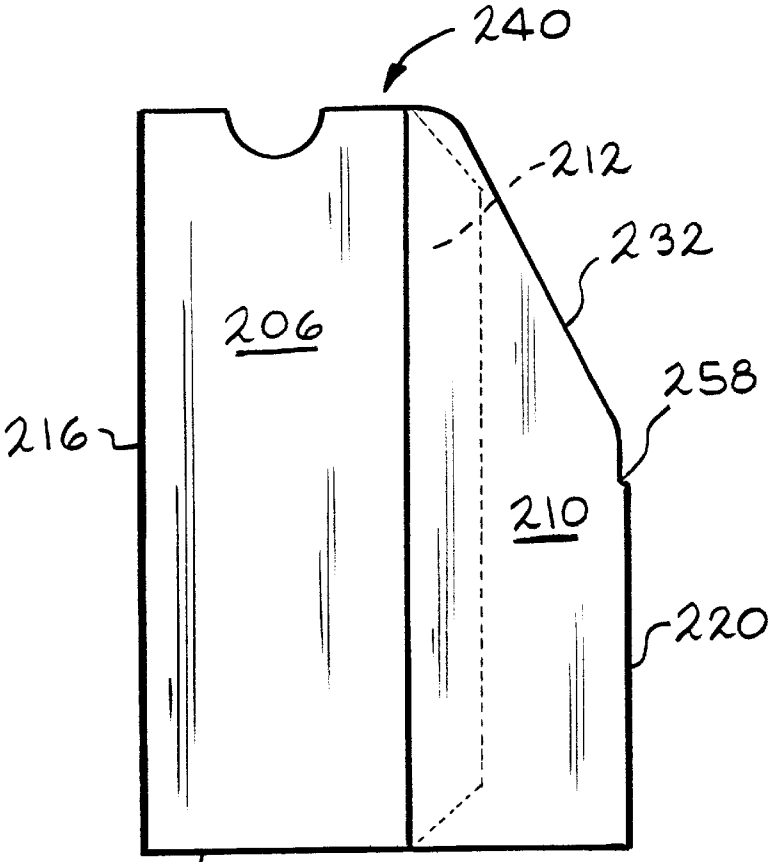
FIG. 16A presents a planar view showing the paperboard blank, as shown in FIG. 12, after its fourth and final folding operation during manufacture.
Figure 15:
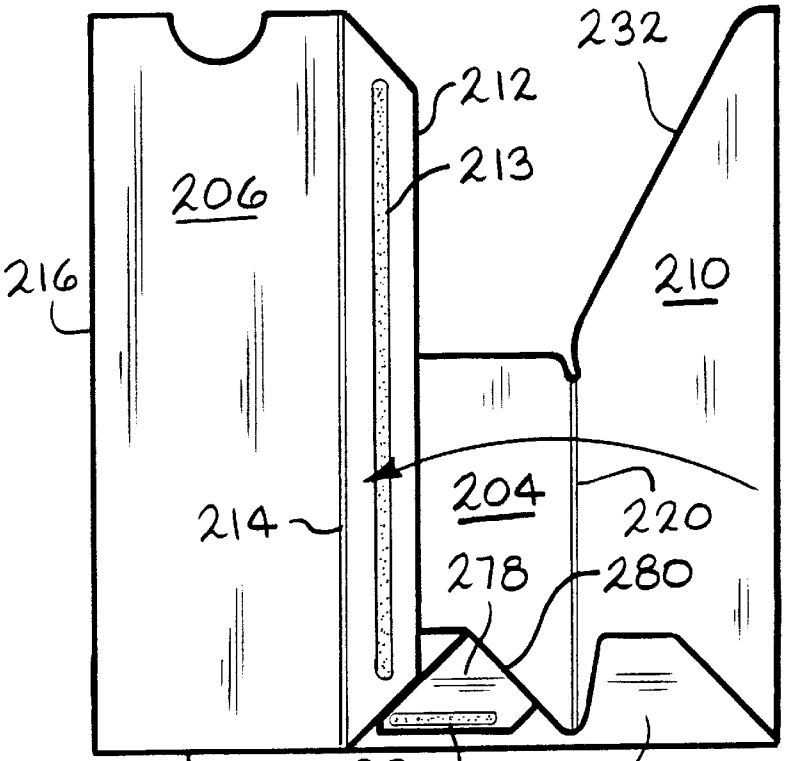
FIG. 15 presents a planar view of the paperboard blank, as shown in FIG. 12, after its third folding operation during manufacture.
Figure 16B:
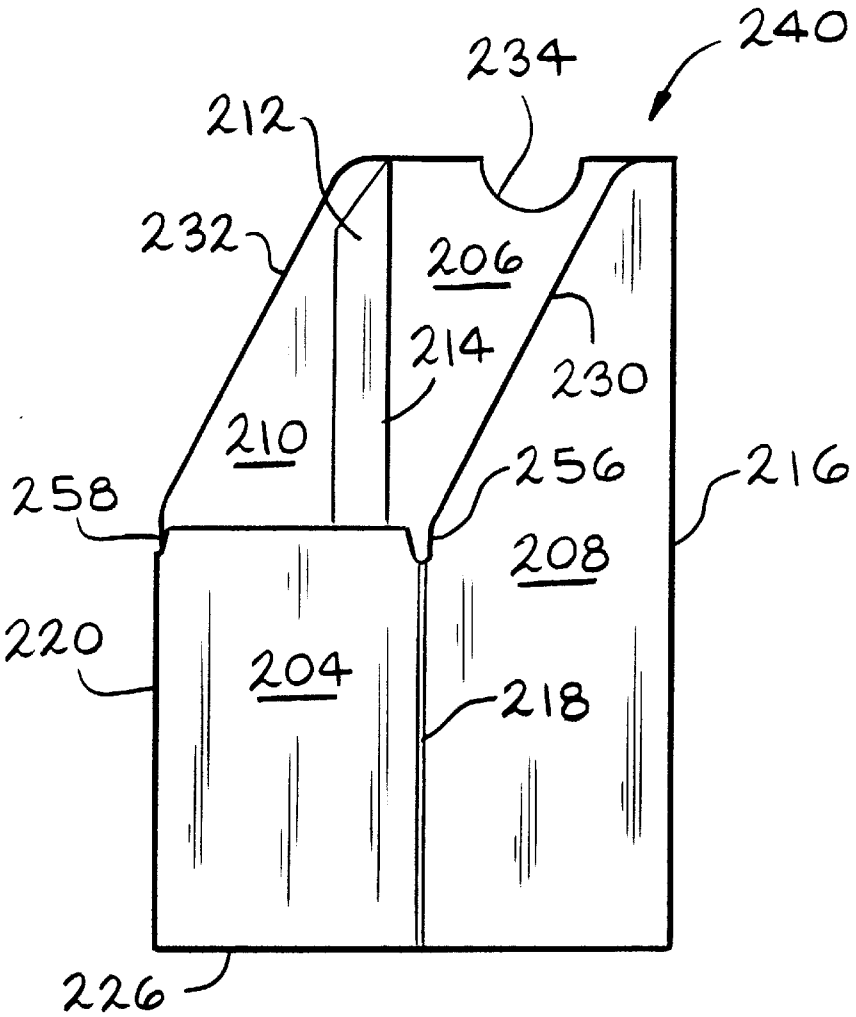
FIG. 16B presents a planar view showing the paperboard blank, as shown in FIG. 16A flipped over 180 degrees to show the front side thereof.

To assemble blank 202 into a flat, expandable perform illustrated in FIGS. 16A and 16B, bottom panels 250, 270, 295, and 290 are first folded upward 180 degrees, as indicated by the arrows in FIG. 12, whereby the bottom panels overlie panels 206, 204, 208, and 210 respectively as illustrated in FIG. 13. Tabs 258 and 278 are then folded downward 180 degrees, as indicated by the arrows in FIG. 13, about fold lines 260 and 280, so as to overlie the main portion 252 of bottom panels 250 and 270 respectively as illustrated in FIG. 14. A suitable adhesive 261 and 281 is applied to tabs 258 and 278 respectively. Tab 258, with adhesive 261 thereon, is folded 180 degrees, about fold line 216, as indicated by the arrow in FIG. 14, so as to over lie side panel 208 and a portion of front panel 204 as illustrated in FIG. 15. It is to be noted that upon making this fold, tab 258 becomes adhered to bottom panel 295 by adhesive line 261. An adhesive line 213 is then applied to glue tab 212 and side panel 210 is folded 180 degrees about fold line 220, as indicated by the arrow in FIG. 15, whereby adhesive 213 adheres side panel 210 to glue tab 212 and bottom panel 290 is adhered to tab 278 by adhesive 281 producing the final flat perform 240 as illustrated in FIG. 16A. FIG. 16B illustrates the perform 240, as illustrated in FIG. 16A flipped over 180 degrees thereby illustrating a front view of the flat final perform 240.

Figure 17:
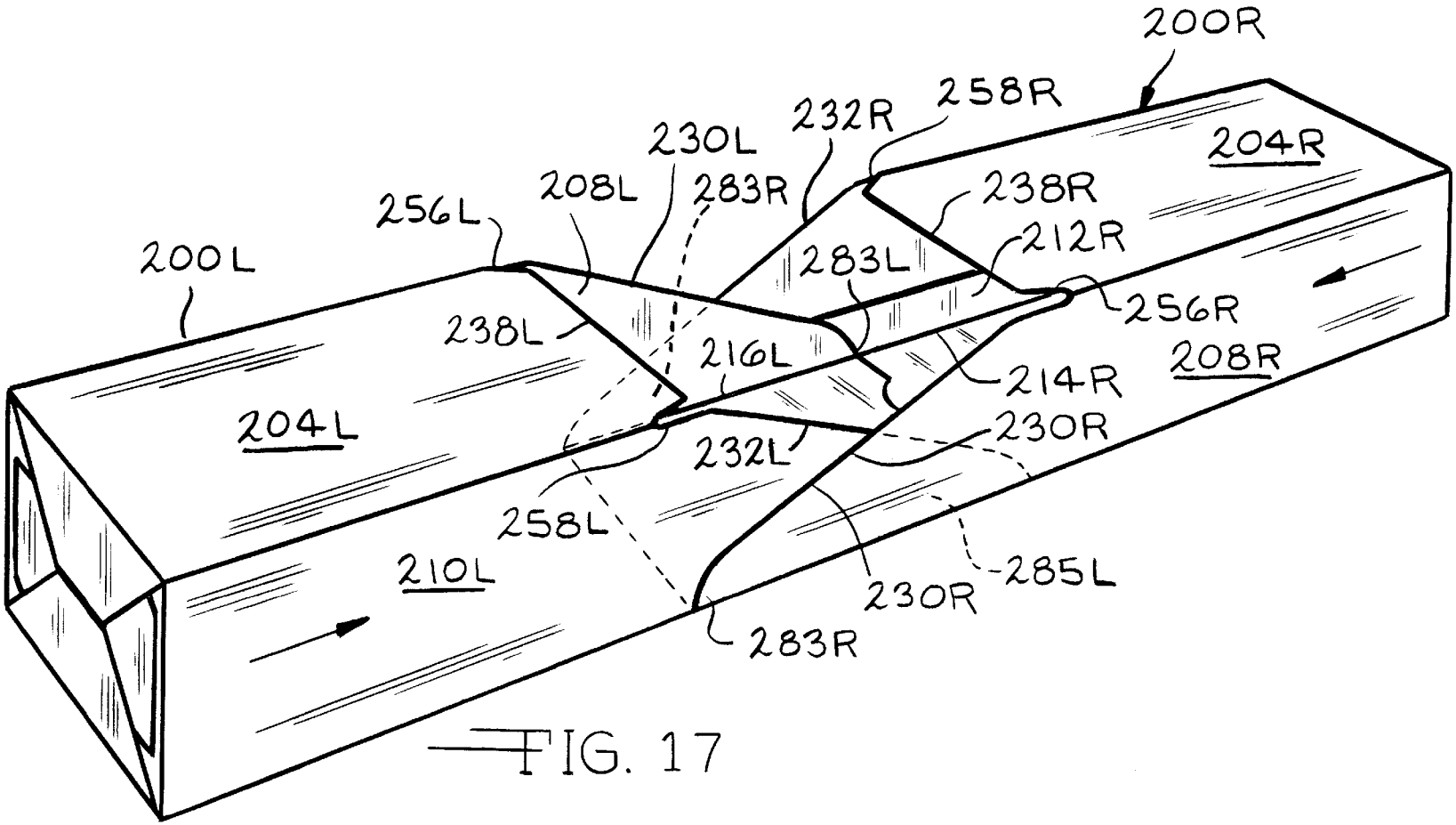
FIG. 17 presents a pictorial view of two of the open ended packages, as illustrated in FIG. 9, being telescoped, one into the other, to form a unique enclosed fast food package.
Figure 18:
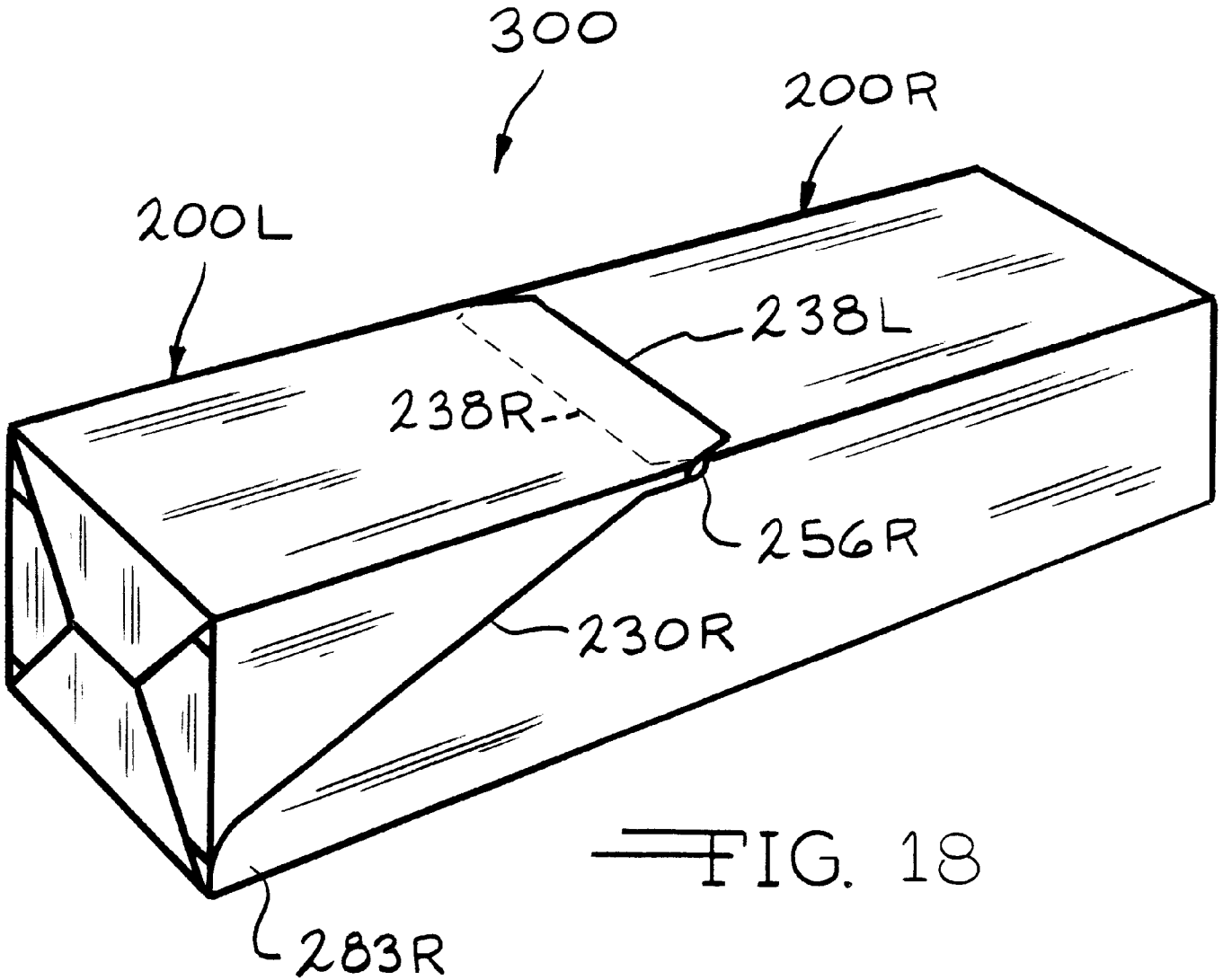
FIG. 18 presents a pictorial view of the final enclosed fast food package formed by telescoping two of the packages, as illustrated in FIG. 9.

Referring now to FIGS. 17 and 18, two identical, open ended, fast food packages, as illustrated in FIG. 9, and identified as 200L and 200R, are illustrated as being assembled (package 200L telescoping into package 200R) to form a composite, enclosed, fast food package 300 illustrated in FIG. 18.

To form enclosed package 300 the left and right corners 283L and 285L, of package 200L are telescoped inside of right and left corners 283R and 285R, respectively and pushed together as indicated by the arrows in FIG. 17. As the gap between tongue 238L and 238R is closed, tongue 238L will override tongue 238R until notches 258L and 256R, on both sides of package 200L and 200R, interlockingly engage each other thereby forming enclosed package 300 as illustrated in FIG. 18.

Having described the preferred embodiments of the present invention, and several of its benefits and advantages, it will be understood by those of ordinary skill in the art that the foregoing description is merely for the purpose of illustration and that numerous substitutions, rearrangements, and modifications may be made in the invention without departing from the scope and spirit of the appended claims.

I claim:

1. An enclosed, modular, package particularly suitable for receiving a food item therein, said package comprising:

a) a first and second package half wherein said first and second halves are identical, said first and second package half each comprising:

1) a front, rear, left side, right side and bottom wall, 2) said rear wall extending upward, from said bottom wall, the full height of said package and said front wall extending upward from said bottom wall beyond the midpoint of said rear wall but below the top edge of said rear wall, 3) said side walls extending between said front and rear wall, each of said side walls having a downwardly extending top edge extending from said rear wall to said front wall and forming a downwardly extending notch therebetween, the bottom of said notch being at the midpoint of said package half thereby defining a tongue extending upward from a an imaginary, horizontal line extending between said side wall notch bottoms, b) said rear wall and said side walls of said first package half telescopingly received inside the rear wall and said side walls of said second package half whereby the notches of said first and second package half interlock and said tongue of said first package half overlaps the tongue of said second package half thereby forming an enclosed package.

2. The modular package as claimed in claim 1 wherein each package half includes means whereby said package half may be folded into a flat configuration.

3. The modular package as claimed in claim 2 wherein said means for folding said package half into a flat configuration includes vertical folding score lines at each of said wall's midpoint and at the juncture of said front and rear walls with said side walls.

4. The modular package as claimed in claim 3 wherein said bottom wall comprises a pop-up bottom.

5. The modular package as claimed in claim 2 wherein said bottom wall comprises an automatic bottom.

6. The modular package as claimed in claim 1 wherein each of said package halves is manufactured from a unitary blank of paperboard material.

7. An enclosed, modular, package particularly suitable for receiving a food item therein, said package comprising:

a) a first and second package half wherein said first and second halves are identical, said first and second package half each comprising:

1) a front, rear, left side, right side and bottom wall wherein the height of said back wall is at least equal to the width of said front wall, 2) said rear wall extending upward, from said bottom wall, the full height of said package and said front wall extending upward from said bottom wall beyond the midpoint of said rear wall but below the top edge of said rear wall, 3) said side walls extending between said front and rear wall, each of said side walls having a downwardly extending top edge extending from said rear wall to said front wall and forming a downwardly extending notch therebetween, the bottom of said notch being at the midpoint of said package half thereby defining a tongue extending upward from a an imaginary, horizontal line extending between said side wall notch bottoms, b) said rear wall and said side walls of said first package half telescopingly received inside the rear wall and said side walls of said second package half whereby the notches of said first and second package half interlock and said tongue of said first package half overlaps the tongue of said second package half thereby forming an enclosed package.

8. The modular package as claimed in claim 7 wherein said rear wall includes an open cutout portion at the top edge of said back wall.

9. The modular package as claimed in claim 8 wherein said cutout is equidistant from said left and right side walls and comprises a semicircle.

10. The modular package as claimed in claim 9 wherein said cutout extends over at least fifty percent of said rear wall's width.

11. The modular package as claimed in claim 9 wherein said cutout extends seventy percent of said rear wall's width.

12. An enclosed, modular, package particularly suitable for receiving a food item therein, said package comprising:

a) a first and second package half wherein said first and second halves are identical, said first and second package half each comprising:

1) a front, rear, left side, right side and bottom wall wherein the height of said back wall is at least twice the width of said front wall, 2) said rear wall extending upward, from said bottom wall, the full height of said package and said front wall extending upward from said bottom wall beyond the midpoint of said rear wall but below the top edge of said rear wall, 3) said side walls extending between said front and rear wall, each of said side walls having a downwardly extending top edge extending from said rear wall to said front wall and forming a downwardly extending notch therebetween, the bottom of said notch being at the midpoint of said package half thereby defining a tongue extending upward from a an imaginary, horizontal line extending between said side wall notch bottoms, b) said rear wall and said side walls of said first package half telescopingly received inside the rear wall and said side walls of said second package half whereby the notches of said first and second package half interlock and said tongue of said first package half overlaps the tongue of said second package half thereby forming an enclosed package.

13. The modular package as claimed in claim 12 wherein said rear wall includes an open cutout portion at the top edge of said back wall.

14. The modular package as claimed in claim 13 wherein said cutout is equidistant from said left and right side walls and comprises a semicircle.

* * * * *